US005267764A

United States Patent [19]

Hoffman et al.

[11] Patent Number: 5,267,764

[45] Date of Patent: Dec. 7, 1993

[54] CEILING ANCHOR INSTALLATION APPARATUS

[75] Inventors: Michael S. Hoffman, Marblehead; Thomas Devlin, Cambridge; Amy Potts, Arlington, all of Mass.

[73] Assignee: Rose Displays, Ltd., Marblehead, Mass.

[21] Appl. No.: 817,433

[22] Filed: Jan. 6, 1992

[51] Int. Cl.[5] ..... A47F 13/06; B25J 1/00

[52] U.S. Cl. ..... 294/19.1; 248/340; 248/544

[58] Field of Search ..... 274/19.1, 24, 85; 40/617, 666; 248/317, 339, 340, 343, 544

[56] References Cited

U.S. PATENT DOCUMENTS

| | | | |
|---|---|---|---|
| 3,175,280 | 3/1965 | Henges | 294/19.1 X |
| 3,327,376 | 6/1967 | Freeman et al. | 294/19.1 X |
| 3,561,718 | 2/1971 | Iverson | 294/19.1 X |
| 4,135,692 | 1/1979 | Ferguson | 248/317 |
| 4,163,576 | 8/1979 | Hoop | 294/19.1 |
| 4,225,108 | 9/1980 | Jaroche | 294/19.1 X |
| 4,249,763 | 2/1981 | Provencher et al. | 294/19.1 |
| 4,269,087 | 5/1981 | Wand | 294/19.1 X |
| 4,323,215 | 4/1982 | Berger | 248/544 |
| 4,564,165 | 1/1986 | Grant et al. | 248/343 |
| 4,679,556 | 7/1987 | Lubock et al. | 294/19.1 X |
| 5,052,733 | 10/1991 | Cheung et al. | 294/19.1 |

*Primary Examiner*—Johnny D. Cherry
*Attorney, Agent, or Firm*—Don Halgren

[57] ABSTRACT

An arrangement for attaching ceiling anchors to ceiling rails, including a bifurcated support which is attachable to an elongated pole. The support is engagable with an installment head which is bifurcated to define a carrying space for ceiling anchors. The installment head is adapted to keep anchors from slipping off of the head as it is moved relative to a ceiling rail.

18 Claims, 2 Drawing Sheets

CEILING ANCHOR INSTALLATION APPARATUS

BACKGROUND OF THE INVENTION (1) Field of the Invention

This invention relates to devices for attaching anchors to flanged ceiling rails.

(2) Prior Art

Hanging displays from ceilings, and changing those displays is a never ending task for merchants, who must change, correct or move displays hanging from ceilings, all the time.

Some devices have been created to aid in anchoring of ad displays from ceilings, but often suffer from handicaps as usually requiring stepladders or the like. Among the art included is U.S. Pat. No. 3,327,376 to Freeman et al; U.S. Patent to Ferguson, U.S. Pat. No. 4,135,692; U.S. Pat. No. 4,163,576 to Hoop; U.S. Pat. No. 4,225,108 to Jaroche; U.S. Pat. No. 4,269,087 to Wand; U.S. Pat. No. 4,323,215 to Berger; and U.S. Pat. No. 4,564,165 to Grant et al.

They represent devices that are complicated to make, require close hand support or ladders to bring the worker to the ceiling.

It is an object of the present invention to provide an anchor installation arrangement for ceiling rails which is simple to use, readily adaptable to a plurality of anchor devices, and which will assist in the removal as well as the attachment of such anchors.

BRIEF SUMMARY OF THE INVENTION

The present invention comprises an anchor installation device which is attachable to the end of a telescoping elongated pole. The anchor installation device includes a generally "Y" shaped bifurcated support having a proximal end of stepped diameter, which is attachable to the telescoping pole.

The bifurcated support is arranged to be matable on its distal end, with several different installation heads. A first installation head comprises an elongated generally U-shaped member adapted primarily for the attachment and removal of magnetic anchors on metal ceiling rails. A second installation head is also attachable to the distal end of the bifurcated support, so as to permit the attachment of "spider" anchors to the metal ceiling rails.

The bifurcated support has a pair of elongated fingers having flattened distal ends. One of the fingers has a boss which mates with a similarly configured slot on the installation heads so as to establish proper mounting therebetween.

The first installation head, of elongated generally U-shaped configuration has a central body portion with a pair of spaced apart slots for receiving the flattened ends of the elongated fingers of the bifurcated support. One of the slots has a recess which mates with the boss on one of the fingers.

The first installation head has an open first end having parallel side rails, which are appropriately spaced so as to receive an elongated rectangularly shaped magnet. The installation head has an upper side having upper teeth extending partially towards one another off of the rails so as to grip a magnet and permit it to be pulled from a metal ceiling rail. The installation head has a lower side having lower teeth extending toward one another off of the side rails so as to hold a magnet between the rails as it is being lifted toward the ceiling rail. A pair of tabs extend off of the lower distal most teeth to prevent an elongated magnet held therein from sliding out the open end of the elongated side rails.

The first installation head also has a bifircuted second end. A transverse channel is disposed across the body. An elongated magnet may be held in the transverse channel. The elongated magnets have a centrally disposed hook extending off of one side. The hook would extend into the slot defining the bifurcation, which is directed, permitting attachment of a sign or display arrangement to the hook.

A circular depression in the upper surface of the second end is adapted to engage a circular adhesive pad. The adhesive pad has a boss on its lowermost side from which a hook would extend. The hook would fit into the aforementioned slot in the second end, enabling a display to be attached thereto.

A hook may be disposed on the outer side of the elongated side rails, to lift displays onto the hooks extending downwardly from the magnets or adhesive anchors.

The second installation head is comprised of a generally planar U-shaped fixture having a base of somewhat square configuration. An elevated boss is disposed on each corner of the base. A slot extends down the center of the base defining a pair of spaced parallel legs. A central portion on each side of the slot has sloped sides. A planar ear extends off of the base from each leg. A narrow groove extends transversely across the legs, including the sloped sides on each side of the slot. The groove is adapted to snugly receive a spider clip which is arranged to grip a T-shaped ceiling rail when twisted thereon. The elevated bosses on each corner of the base push up ceiling tiles out of the way slightly so that the spider clip can engage the ceiling rail without interference.

The first and second installation heads are interchangable with respect to the bifurcated support/each permitting its own type of anchor to be secured to the ceiling rail with relative ease.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
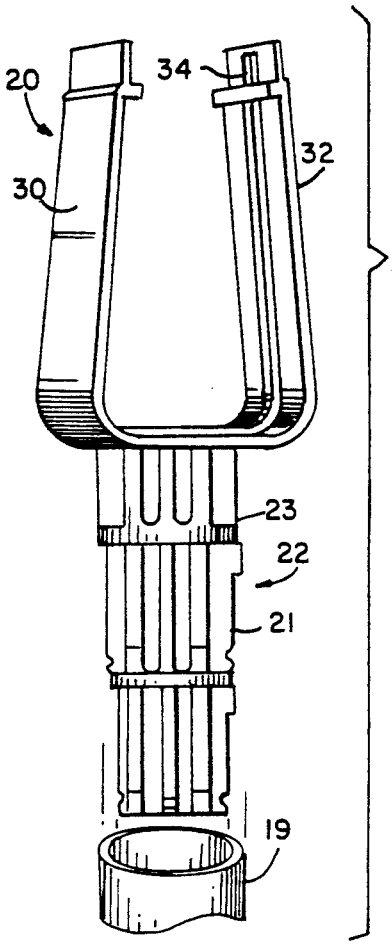
FIG. 1 is a perspective view of a bifurated support utilized for securing an installation head to a pole.

Referring now to the drawings in detail, and particularly to FIG. 1, there is shown a bifurcated support 20 which is adaptable for emplacement onto a telescoping pole 19, for securement of an installation head utilized to attach anchors to ceiling rails. This invention is related to the invention shown in commonly assigned U.S. Pat. No. 5,052,733, which is incorporated herein by reference.

Figure 2:
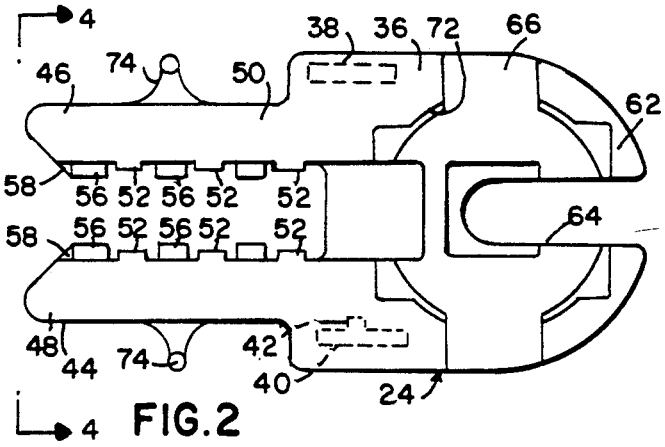
FIG. 2 is a plan view of an installation head adaptable to receive various types of anchors for securement/retrieval from a ceiling rail.
Figure 3:
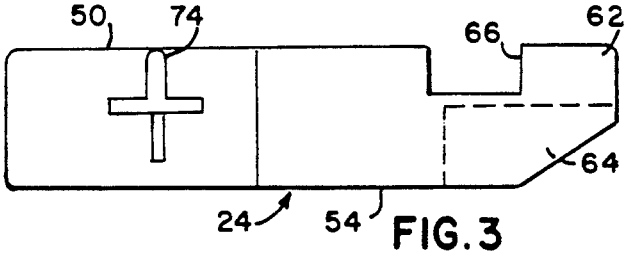
FIG. 3 is a side view of the installation head shown in FIG. 2.
Figure 5:
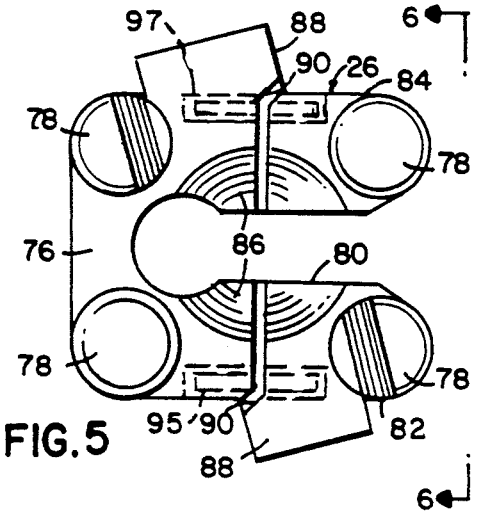
FIG. 5 is a plan view of a further installation head.
Figure 9:
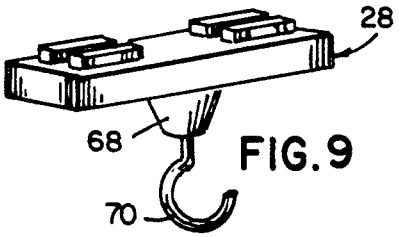
FIG. 9 is a perspective view of a magnetic anchor utilizable with the installation head shown in FIG. 2.

The bifurcated support 20 has a proximal end 22, of stepped diameters 21 and 23, adapted to be received in different size openings, if necessary, on the distal end of the telescoping pole 19, and is arranged to be matable, on its distal end, to different installation heads 24 and 26, shown in FIGS. 2 and 5, respectively. The first installation head 24, shown in FIG. 2, comprises an elongated generally U-shaped member, adaptable for the attachment of magnetic anchors 28, generally as shown in FIG. 9.

The bifurcated support 20 has a pair of elongated fingers 30 and 32 having flattened distal ends. One finger 32 has a narrow elongated key 34 on one side thereof, as shown in FIG. 1, which mates with a similarly configured slot on each of the installation heads 24 and 26 as described herein below.

The first installation head 24 has a central body portion 36 with a pair of spaced apart slots 38 and 40 adapted to receive the flattened distal ends of the elongated fingers 30 and 32 of the bifurcated support 20. One of the slots 40 has a recess 42 which mates with the key 34 on one finger 32.

Figure 4:
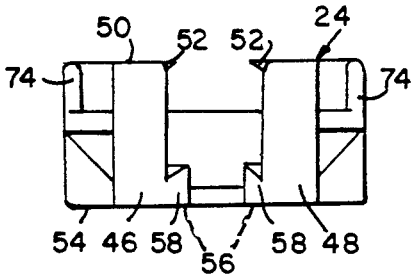
FIG. 4 is a view taken along the lines IV—IV of FIG. 2.
Figure 10:
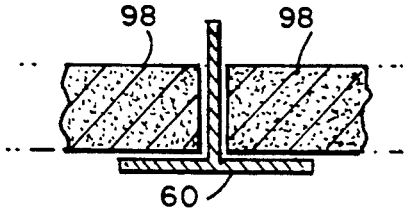
FIG. 10 is a cross-sectional view of a ceiling rail and ceiling tiles in a ceiling.

The first installation head 24 has an open first end 44 having parallel side rails 46 and 48. The first installation head 24 has an upper side 50 and a plurality of short, spaced apart upper teeth 52 extending off of the upper side 50 across the space between the side rails 46 and 48, and towards one another, as shown in FIGS. 2 and 4. The first installation head 24 has a lower side 54 having short, spaced apart lower teeth 56 extending towards one another off of the bottom side 54 of the side rails 46 and 48. A tab 58 extends slightly upwardly of and distal of the distalmost lower tooth 56, the upper and lower teeth 52 and 56 acting to hold a magnetic type anchor 28 therebetween, as it is lifted towards or away from a ceiling rail 60, of inverted T-shape in cross section, which ceiling rail 60 is shown in FIG. 10.

The first installation head 24 also has a bifurcated second end 62, as shown most clearly in FIG. 2. The second end 62 is bifurcated by a central slot 64. A transverse channel 66 is disposed across the central body portion 36, which likewise is dimensioned so as to cradle an elongated magnetic anchor 28, thereacross. The magnetic anchors 28 typically have a boss 68 centrally disposed therein, as shown in FIG. 9. A hook 70 or eye extends outwardly from the boss 68. During installation of a magnetic anchor 28, the boss 68 and hook 70 would extend downwardly through the slot 64 as it is lifted towards a ceiling rail 60.

The second end 62 of the first installation head 24 may have a circular depression 72 extending thereon, which permits the first head 24 to engage a circular adhesive anchor, not shown, having a boss and hook directed downwardly through the slot 64 as would the boss and hook of a magnetic anchor 28. A leader or elongated line may extend from the respective hooks of the anchors, to any display sign thereattached.

An engagement hook 74 is arranged in the outer side of each side rail 48 and 46. The engagement hook 74 permits the emplacement and removal of display sign lines onto the anchor hooks through the manipulation of the first installation head 24 on the upper end of a telescoping pole, not shown.

Figure 6:
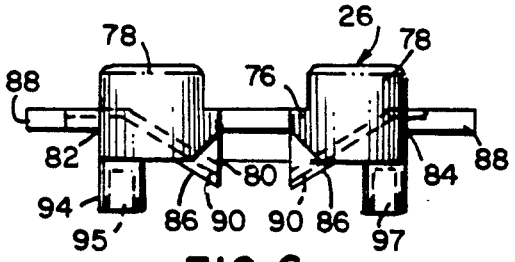
FIG. 6 is a view taken along the lines VI—VI of FIG. 5.
Figure 7:
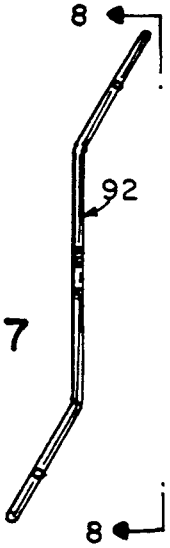
FIG. 7 is a plan view of a spider clip.
Figure 8:
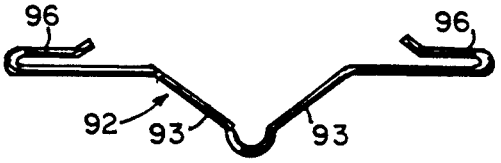
FIG. 8 is a view taken along the lines VIII—VIII of FIG. 7.

The second installation head 26, as shown in FIGS. 5 and 6, is comprised of a generally square shaped planar base 76, having an elevated boss 78 on each corner thereof. A slot 80 extends across most of the base 76, and defines a pair of spaced apart parallel legs 82 and 84. A central portion 86 on each side of the slot 80 is of sloped configuration. A planar alignment ear 88 extends angularly off of each side of the base 76. The alignment ears 88 provide an alignment means when the second head 24 is attached to its bifurcated support 20. The ears 88 are caused to line up parallel to the lower portion of the ceiling rail 60. A narrow groove 90 is molded across each leg 82 and 84 as shown in FIG. 5, including the central sloped portion 86. The groove 90 is configured to snugly receive a spider clip 92, which clip 92 is shown in FIGS. 7 and 8. A pair of feet 94 extend downwardly on the bottomside of the base 76 at the legs 82 and 84, as shown in FIG. 6. A pair of slots 95 and 97 are molded into the feet 94, which receive the elongated fingers 30 and 32.

When attaching a spider clip 92, which mates with the groove 90 in the second head 26, the clip 92 has sloped portions 93 which mate correspondingly with those sloped portions 86 of the groove 90. The alignment ears 88 are manipulated into alignment with the longitudinal axis of the ceiling rail 60, and then the head 26 is rotated so as to engage the bent ends 96 onto the inverted "T" ceiling rail 60. The elevated bosses 78 on each corner of the second head 26 push the ceiling tiles 98 up out of the way slightly, as the spider clip 92 is being rotatively engaged thereon, without interference from those tiles 98.

The first and second interference heads 24 and 26 are interchangably disposable with respect to the bifurcated support 20, each permitting its own arrangement of ceiling anchors to be secured to a ceiling rail, with relative ease.

We claim:

1. An arrangement for attachment of ceiling rail anchors to a ceiling rail supporting a ceiling, comprising:

a bifurcated support having distal and proximal ends, the proximal end being attachable to a receiving end of an elongated pole, said support having a pair of elongated fingers on its distal end;

a bifurcated installation head securable to the elongated fingers of said bifurcated support;

said bifurcated head having an anchor supporting means for gripping rail anchors for delivery to and from a ceiling rail;

one of said elongated fingers having an alignment key on one side thereof so as to establish proper location of an installation head on said support; and wherein said installation head has a first and a second end, each of which is bifurcated for engagement with a ceiling anchor.

2. An arrangement for attachment of ceiling anchors, as recited in claim 1, wherein said first end has a pair of parallel arms which between them define a space for containing a magnetic anchor.

3. An arrangement for attachment of ceiling anchors, as recited in claim 2, wherein said parallel arms have an arrangement of upper spaced teeth directed towards one another along said arms so as to permit a magnetic anchor to be engaged thereby when said anchor is in the space between the arms, to permit the anchor to be removed from a ceiling rail.

4. An arrangement for attachment of ceiling anchors, as recited in claim 2, wherein said parallel arms have an arrangement of lower spaced teeth directed towards one another and along said arms so as to permit an elongated magnetic anchor to be engaged within the space between said arms as said anchor is lifted upwardly towards a ceiling rail.

5. An arrangement for attachment of ceiling anchors, as recited in claim 4, wherein said lower teeth on said parallel arms have a raised tab thereon, to prevent any magnetic anchor being lifted to or from a ceiling rail from sliding out from the support of said lower opposed teeth on said arms.

6. An arrangement for attachment of ceiling anchors, as recited in 1, wherein said second end has a slot which defines a pair of parallel arms therealongside.

7. An arrangement for attachment of ceiling anchors, as recited in claim 6, wherein a channel is disposed transversely across said installation head for receipt of a magnetic anchor, said slot arranged for the passage of a hook disposed off of the bottomside of said magnetic anchor.

8. An arrangement for attachment of ceiling anchors, as recited in claim 6, wherein said second end has a circular depression therein, to enable said installation head to receive an anchor, said anchor having a boss and hook extending through said slot, for attachment of said anchor to a ceiling rail.

9. An arrangement for attachment of ceiling anchors, as recited in claim 1, wherein said installation head has a planar base of generally square configuration having an elevated boss on each corner thereof, said installation head being arranged so as to deliver and retrieve a bent spider wire clip ceiling anchor to a ceiling rail.

10. An arrangement for attachment of ceiling anchors, as recited in claim 9, wherein said base has an elongated slot therein defining a pair of parallel legs.

11. An arrangement for attachment of ceiling anchors, as recited in claim 10, wherein said base has a narrow groove molded thereacross, to snugly receive a bent spider wire clip therein.

12. An arrangement for attachment of ceiling anchors, as recited in claim 11, said base has a sloped surface and said wire clip has a sloped configuration, said base and said wire clip having corresponding contours along said narrow groove to ensure proper mating engagement therebetween.

13. An arrangement for attachment of ceiling anchors, as recited in claim 12, wherein said base has alignment means thereon, to facilitate alignment of said wire clip prior to rotational engagement of said head and said wire clip into mating relationship with said ceiling rail.

14. An arrangement for attachment of ceiling anchors as recited in claim 1, wherein the proximal end of said bifurcated support has successively stepped diameters to permit the support to be mated with any differently sized receiving ends of different poles.

15. A ceiling anchor attachment apparatus for attaching a ceiling anchor to a steel ceiling rail, comprising:

a bifurcated support which is securable to an elongated pole for reaching high ceiling rails;

an installation head of elongated configuration having means for carrying an elongated magnet towards a ceiling rail and having means for clasping and removing a magnetic anchor from a ceiling rail;

a tab means on said installation head to prevent a magnetic anchor from sliding out of said carrying means as the magnetic anchor is being moved relative to a ceiling rail.

16. A ceiling anchor attachment apparatus as recited in claim 15, also including a hook means for lifting and removing a display sign from an anchor attached to a ceiling rail.

17. A ceiling anchor attachment apparatus as recited in claim 15, including a recess means adjacent an elongated slot, to permit an anchor to be lifted upwardly to a ceiling rail, said anchor having a downwardly projecting boss and hook, disposed through said slot, without interference therewith.

18. A method of installing ceiling anchors onto a steel ceiling rail in a ceiling, comprising the steps of:

arranging a bifurcated support on the end of an elongated pole;

securing a bifurcated installation head onto said bifurcated support; sliding a magnetic anchor into a carrying space on aid installation head;

moving said installation head against a ceiling rail so as to effectuate magnetic attraction between said magnetic anchor and said rail;

sliding said installation head off of said magnetic anchor attached to the rail; and preventing the slippage of said magnetic anchor from said carrying space by arranging blocking tabs on said head adjacent said space to secure said anchor therewithin.

* * * * *